US008398509B2

(12) United States Patent
Elpers

(10) Patent No.: US 8,398,509 B2
(45) **Date of Patent: *Mar. 19, 2013**

(54) BASKETBALL BACKBOARD AND RIM MOUNTING SYSTEM

(75) Inventor: Philip Elpers, Evansville, IN (US)

(73) Assignee: Indian Industries, Inc., Evansville, IN (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/490,561

(22) Filed: Jun. 7, 2012

(65) Prior Publication Data

US 2012/0244964 A1 Sep. 27, 2012

Related U.S. Application Data

(63) Continuation of application No. 12/710,606, filed on Feb. 23, 2010, now Pat. No. 8,206,247.

(51) Int. Cl.
*A63B 63/08* (2006.01)

(52) U.S. Cl. ..... 473/484; 473/481

(58) Field of Classification Search ..... 473/480, 473/481, 482–486; D26/140
See application file for complete search history.

(56) References Cited

U.S. PATENT DOCUMENTS

| | | | | |
|---|---|---|---|---|
| 4,781,375 | A * | 11/1988 | Nye | 473/484 |
| 4,805,904 | A * | 2/1989 | Nye | 473/486 |
| 5,738,601 | A * | 4/1998 | Hughes | 473/484 |
| 5,919,102 | A | 7/1999 | Smith et al. | |
| 6,179,733 | B1 | 1/2001 | Story | |
| D498,800 | S | 11/2004 | Nye et al. | |
| 6,824,481 | B1 * | 11/2004 | Nye et al. | 473/481 |
| 6,932,725 | B2 * | 8/2005 | Monsen | 473/484 |
| 7,048,655 | B2 | 5/2006 | Nye et al. | |
| 7,097,574 | B2 | 8/2006 | Nye et al. | |
| 7,320,652 | B2 * | 1/2008 | Kilpatrick | 473/483 |
| 8,206,247 | B2 * | 6/2012 | Elpers | 473/484 |
| 2005/0003910 | A1 * | 1/2005 | Nye et al. | 473/481 |
| 2006/0183574 | A1 * | 8/2006 | Stanford et al. | 473/481 |
| 2006/0287141 | A1 | 12/2006 | Nye et al. | |
| 2007/0042843 | A1 | 2/2007 | Nye et al. | |
| 2007/0178994 | A1 * | 8/2007 | White et al. | 473/481 |
| 2007/0191151 | A1 | 8/2007 | Nye et al. | |

* cited by examiner

*Primary Examiner* — Gene Kim
*Assistant Examiner* — M Chambers
(74) *Attorney, Agent, or Firm* — Woodard, Emhardt, Moriarty, McNett & Henry LLP

(57) ABSTRACT

Certain embodiments of the present system deal with a basketball goal assembly which adjustably supports a backboard assembly and a rim assembly to enable players to play the game of basketball. In certain preferred aspects, the rim assembly is connected directly to the support arrangement so that force applied to the rim assembly is transmitted directly to the support assembly and is not transferred to the backboard assembly.

19 Claims, 7 Drawing Sheets

BASKETBALL BACKBOARD AND RIM MOUNTING SYSTEM

REFERENCE TO RELATED APPLICATIONS

The present application is a continuation of U.S. patent application Ser. No. 12/710,606, filed Feb. 23, 2010, now U.S. Pat. No. 8,206,247, which is hereby incorporated by reference in its entirety.

FIELD OF THE INVENTION

The present invention deals with basketball goals, and specifically deals with an arrangement to mount a basketball backboard and a rim to a support arrangement.

BACKGROUND OF THE INVENTION

With the rise in popularity of the sport of basketball and the frequency of larger players, it has become a well-known and sensational shot to "slam dunk" or dunk the ball. When a player dunks the ball, the player jumps to a position adjacent to and preferably above the basketball rim, stuffs the ball through the net, and may impact, hold or hang from the basketball rim. In such a situation, the sudden impact force combined with a rigid rim structure can lead to injury of the player or damage to the rim and/or backboard. As a result, resilient breakaway basketball rims have become popular.

A typical breakaway basketball goal includes a rim assembly including a rim and an attachment bracket. The attachment bracket is attached to the backboard. Frequent impacts and/or sudden shear pressures can wear on the bracket, leading to breakage of the bracket and/or backboard. Accordingly, there is a need for a safer backboard and basketball rim mounting system. The present invention addresses these needs.

SUMMARY OF THE INVENTION

Certain embodiments of the present system deal with a basketball goal assembly which adjustably supports a backboard assembly and a rim assembly to enable players to play the game of basketball. In certain preferred aspects, the rim assembly is connected directly to the support arrangement so that force applied to the rim assembly is transmitted directly to the support assembly and is not transferred to the backboard assembly. In one embodiment a basketball goal system, includes a support having a base end and an upper end, a backboard assembly including a backboard panel and a basketball rim assembly. The backboard panel defines a rim assembly opening. A parallelogram structure has at least one upper arm with a rearward end pivotally connected to the support and at least one lower arm with a rearward end pivotally connected to the support. The parallelogram structure includes at least one forward arm having a lower end pivotally connected to a forward end of the lower arm, a central pivot point pivotally connected to a forward end of the upper arm and an upper end connected to the backboard assembly. A brace extends forward from the forward parallelogram arm and is connected to the basketball rim assembly through the rim assembly opening.

In another embodiment, a basketball goal system includes a support supported at a vertical relationship to a support surface and defining a vertical axis substantially perpendicular to the support surface and a backboard assembly. A parallelogram structure mounts the backboard assembly to a forward side of the support. The parallelogram structure includes at least one upper arm pivotally connected to the support at a point offset forward from the vertical axis and at least one lower arm pivotally connected to the support at a point offset rearward from the vertical axis.

It is a preferred object of the present invention to provide an improved basketball goal assembly.

Further objects, features and advantages of the present invention shall become apparent from the detailed drawings and descriptions provided herein.

DESCRIPTION OF PREFERRED EMBODIMENTS

Figure 1:
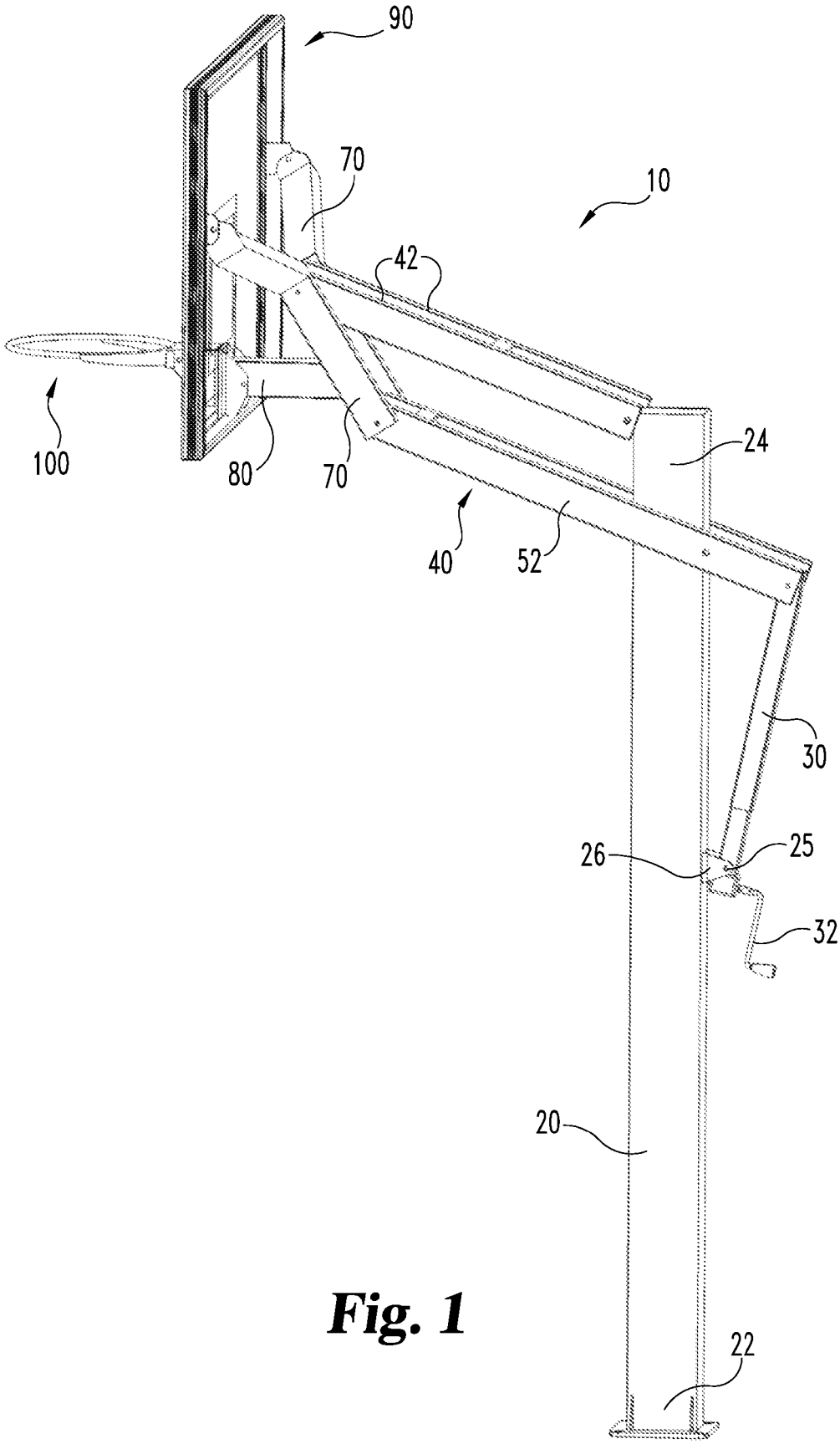
FIG. 1 is a perspective side view of a basketball assembly according to a preferred embodiment of the present disclosure.

For the purposes of promoting an understanding of the principles of the invention, reference will now be made to the embodiments illustrated and specific language will be used to describe the same. It will nevertheless be understood that no limitation of the scope of the invention is thereby intended, such alterations, modifications, and further applications of the principles of the invention being contemplated as would normally occur to one skilled in the art to which the invention relates.

Certain embodiments of the present system deal with a basketball goal assembly which adjustably supports a backboard assembly and a rim assembly to enable players to play the game of basketball. In certain preferred aspects, the rim assembly is connected directly to the support arrangement so that force applied to the rim assembly and is not transferred to the backboard assembly.

Generally, basketball system 10 as shown in FIGS. 1-7 includes a support element extending upward from a support surface. An adjustable parallelogram structure extends on a forward side of the upright to support and holds the backboard assembly 90 and the rim assembly 100. A portion of the parallelogram structure extends rearwardly of the support element and can be moved upward or downward, for example with a telescoping cylinder connected to the upright, to adjust the height of the backboard assembly and rim assembly relative to the support surface is transmitted directly to the support In the illustrated embodiment of FIGS. 1-3, assembly 10 includes an upright support 20 typically formed as a vertical tube or pole. In certain preferred embodiments, the support 20 defines a vertical pole axis P-P perpendicular to the support surface, although in certain less preferred embodiments an angled upright may be used. Support 20 has a lower end 22 supported by a support surface, typically through an in-ground installation or on a portable base. Support 20 has an upper end 24 to which the parallelogram assembly 40 is mounted.

Parallelogram assembly 40 includes at least one and preferably a pair of upper arms 42 pivotally mounted adjacent their rearward ends 44 to points adjacent upper end 24 of the support, and at least one and preferably a pair of lower arms 52 also pivotally mounted to points adjacent the upper end 24 of the support 20. In the illustrated embodiment, rear portions 54 of lower arms 52 include an extension portion 58 extending rearwardly of support 20. Extension end 58 is pivotally mounted to an upper end of a telescopic extension cylinder 30 which extends downward and is linked to a midpoint of support 20. The lower end of cylinder 30 is connected at a pivot point 25 to a pair of flanges 26 mounted on the rear face of support 20. A crank member 32 can be controlled by a user to extend or retract telescoping cylinder 30 and to correspondingly raise or lower extension end 58 of the parallelogram structure. Telescoping cylinder may have a round, square or alternate cross-section. Extension end 58 may alternately be a rearward portion of one or both of upper arms 42.

Figure 2:
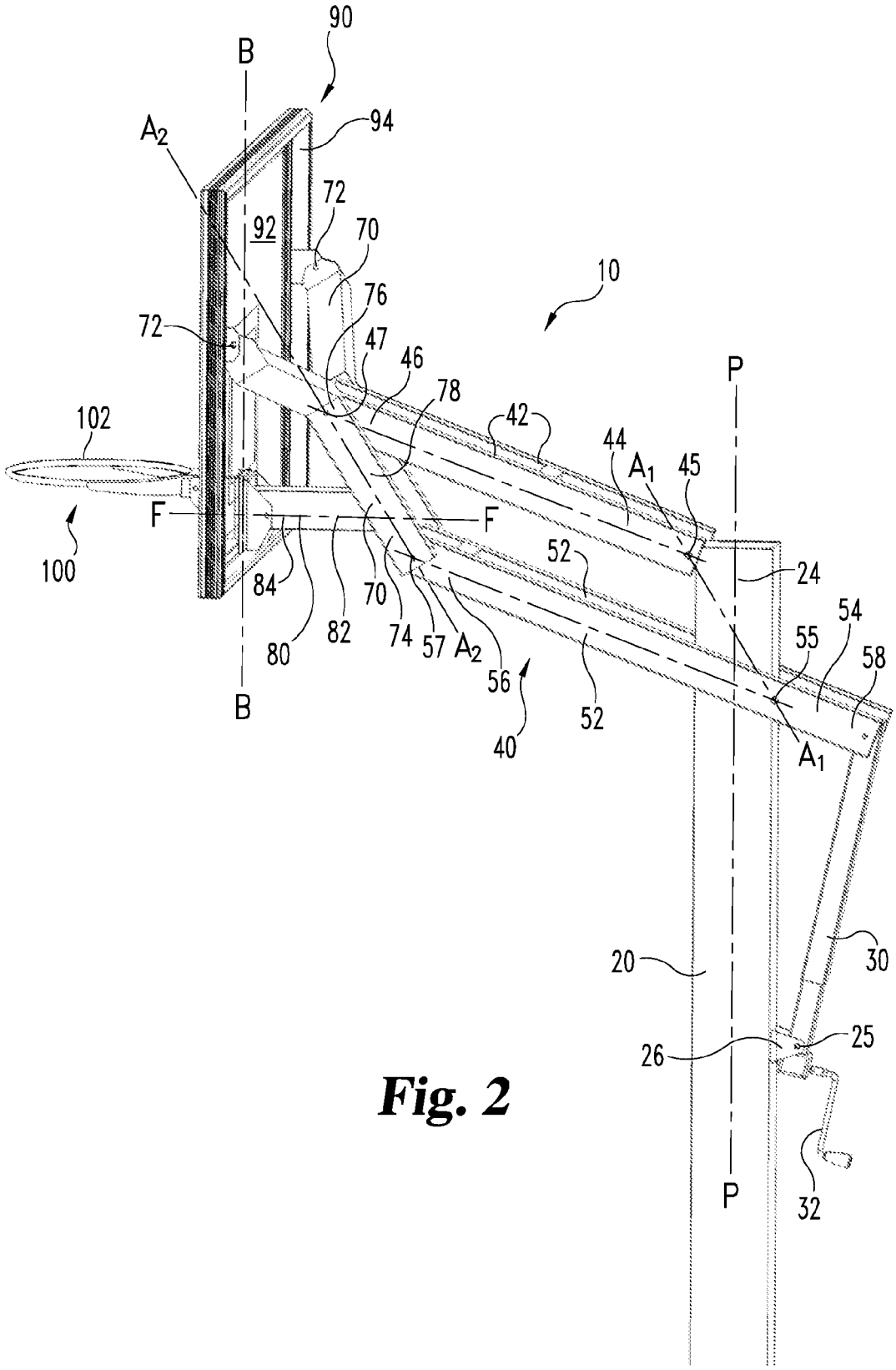
FIG. 2 is a side view of the support assembly, backboard assembly and rim assembly according to the embodiment of FIG. 1.
Figure 5:
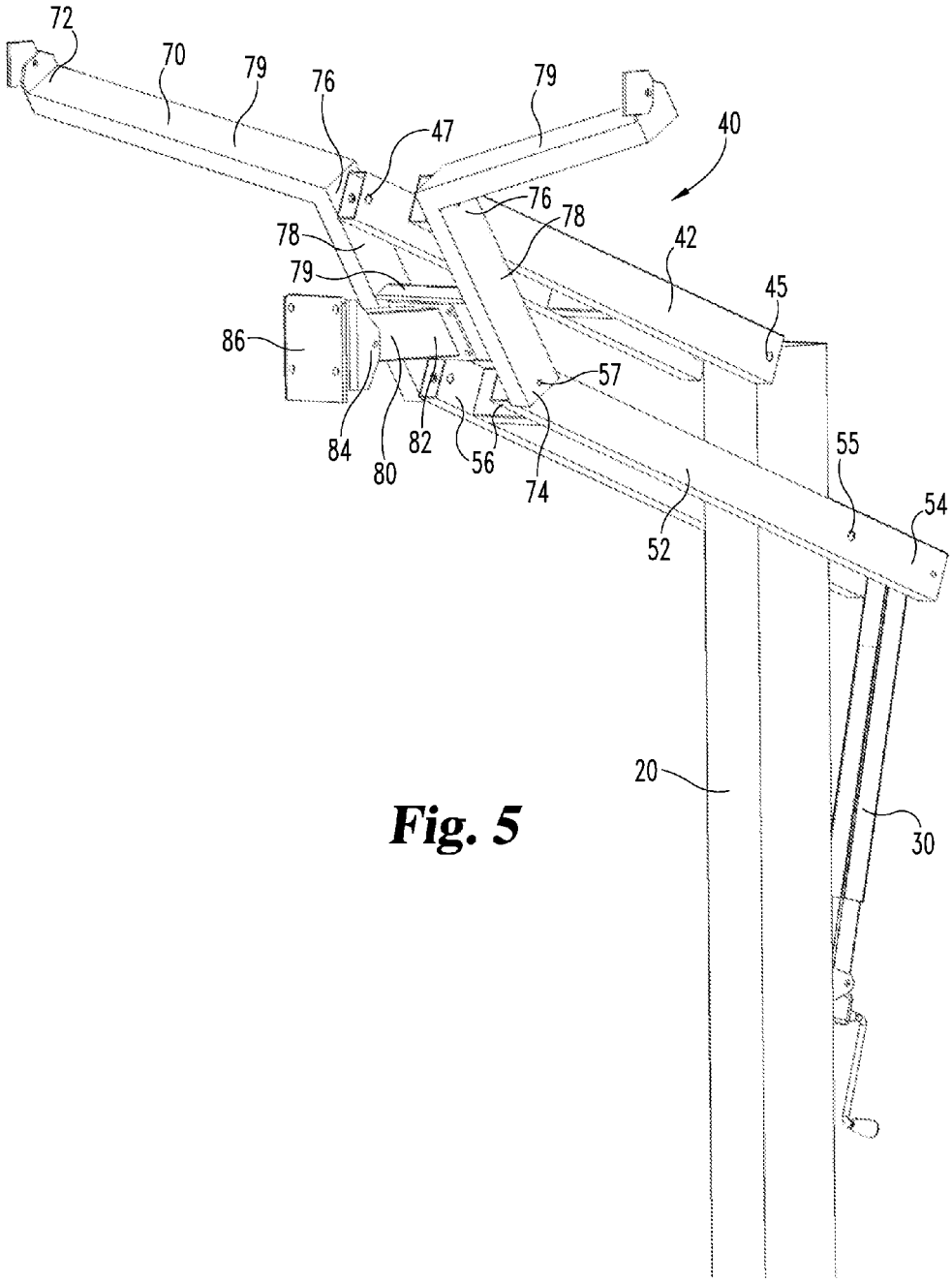
FIG. 5 is a view of the embodiment of FIG. 4 without the backboard assembly.
Figure 6:
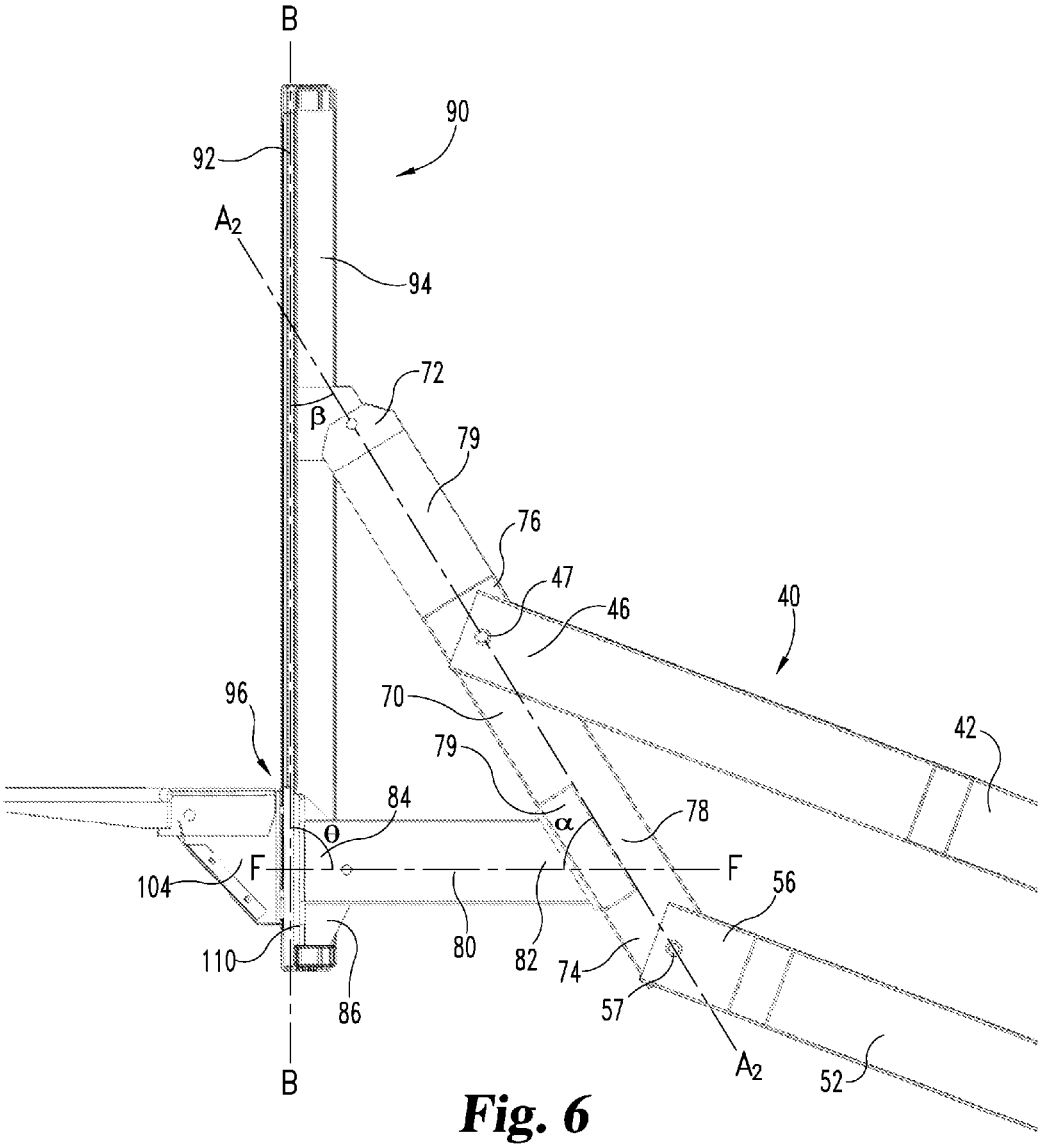
FIG. 6 is a cross-sectional view of the embodiment of FIG. 2.

As seen most clearly in FIGS. 2, 5 and 6, a pair of forward "Y" arms 70 have lower ends 74 connected to the forward ends 56 of lower arms 52, central points 76 pivotally connected to the forward ends 46 of upper arms 42 and upper ends 72 which are mounted to the backboard assembly 90. In certain embodiments the upper ends 72 are connected to opposite vertical side edges of backboard assembly 90. In some embodiments, upper ends 72 are connected to backboard assembly in a non-pivoting fixed angular arrangement. As illustrated, forward arms 70 include central portions 78 between central points 76 and lower ends 74 and offset lengths 79 to offset the upper ends horizontally outward from said central pivot points. In alternate embodiments only one arm or a different arrangement of arms can extend from the parallelogram assembly 40 to support the backboard assembly 90.

Preferably the four pivot points or pairs of pivot points defined by arms 42, 52 and 70 and support 20, namely upper rear pivot points 45, lower rear pivot points 55, upper forward pivot points 47 and lower forward pivot points 57 define an adjustable parallelogram structure which causes upper arms 42 and lower arms 52 to remain in parallel during adjustment of the parallelogram.

Figure 3:
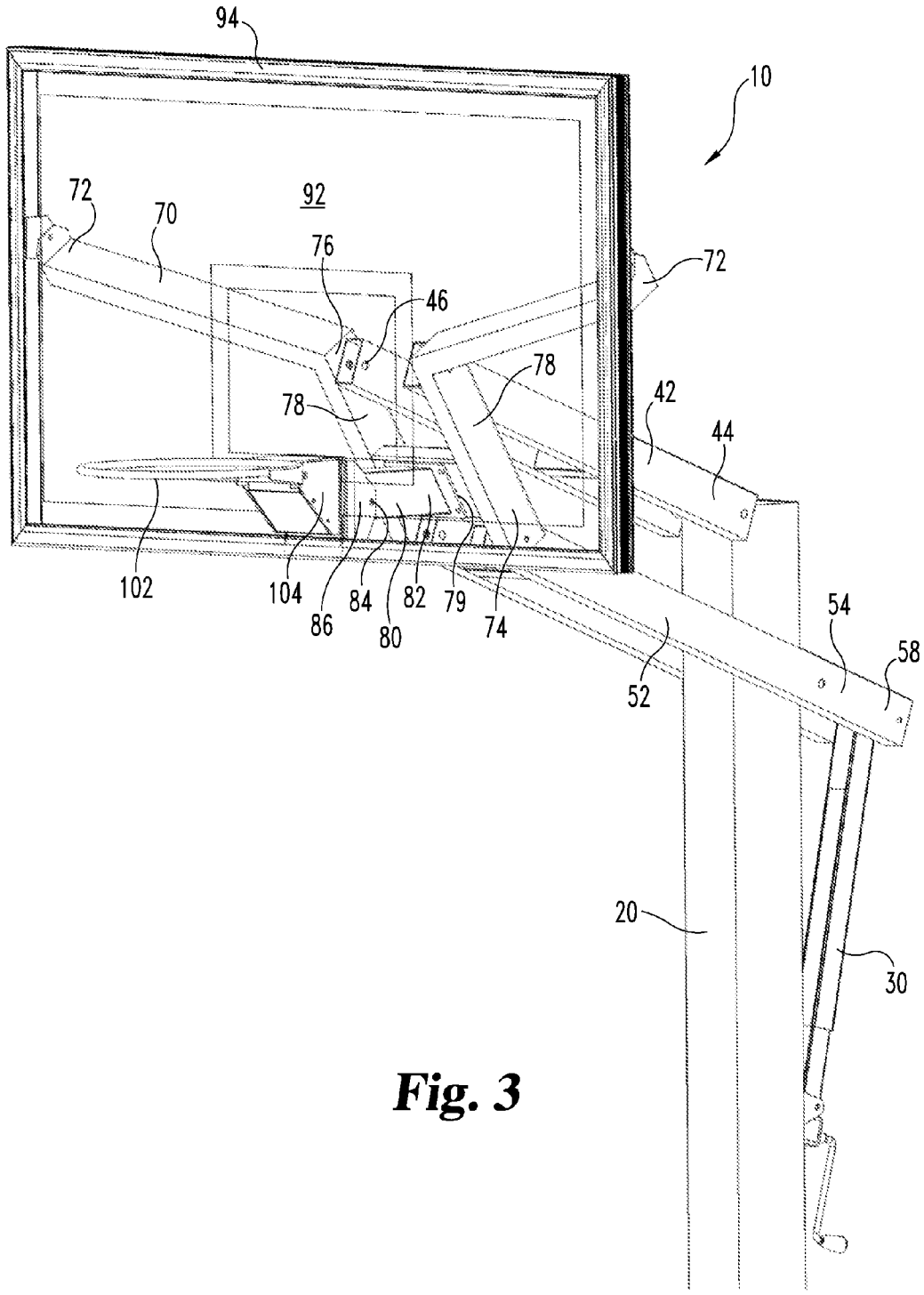
FIG. 3 is a front view of the embodiment of FIG. 2.
Figure 4:
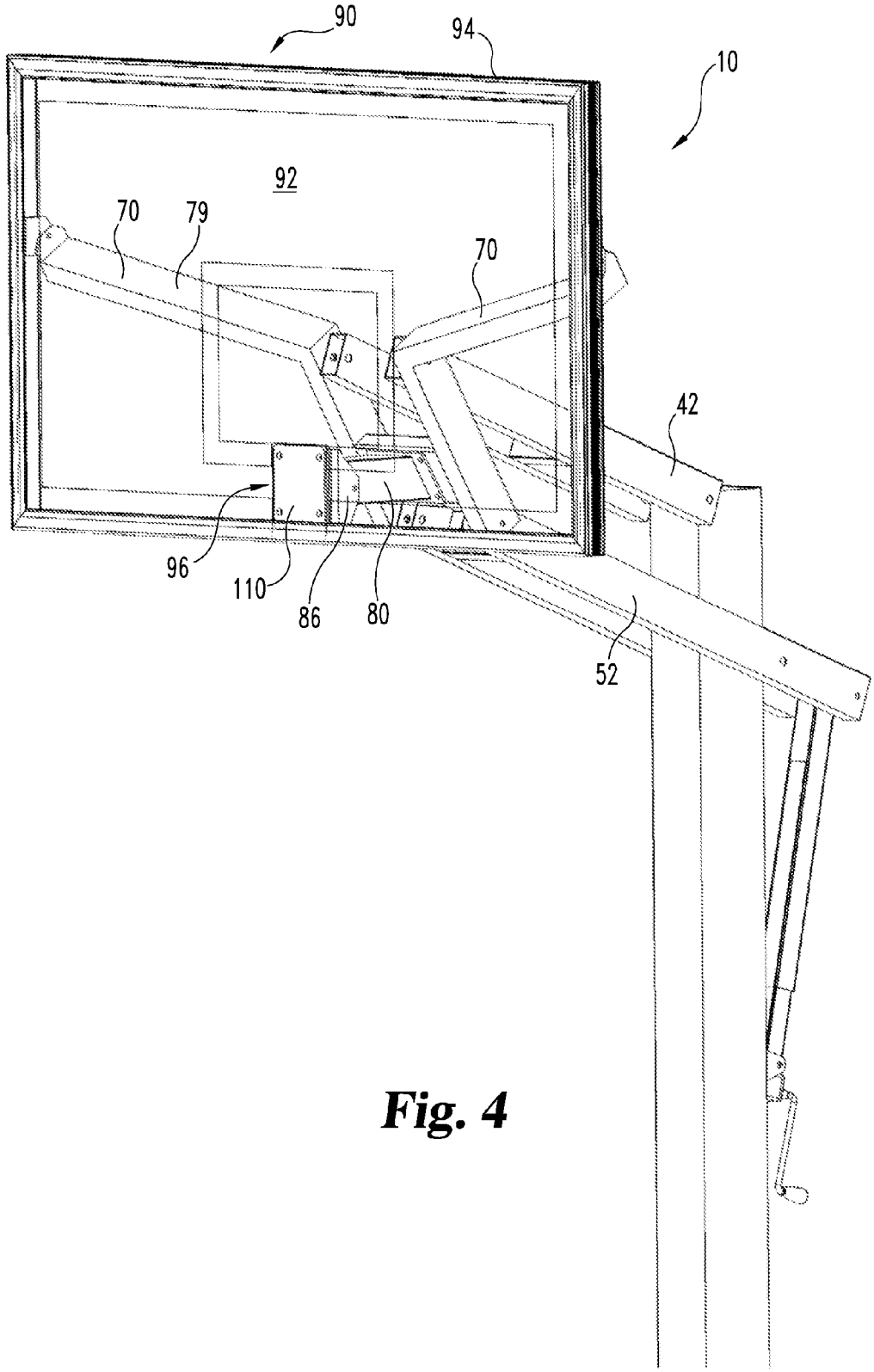
FIG. 4 is a perspective front view of the embodiment of FIG. 3 without the rim assembly.

As shown in further detail in FIGS. 3, 4 and 5, in the illustrated embodiment a crossbar 79 extends between central portions 78 of forward arms 70. A brace arm 80 extends forward along axis F-F from a rear end 82 mounted to crossbar 79 to a forward end 84 connected to a forward bracket 86.

Basketball rim assembly 100 includes a rim 102 and a rearward bracket 104. Basketball rim 102 typically extends forward from bracket 104. Backboard assembly 90 includes a backboard panel member 92 in a vertical plane along axis B-B. The backboard panel is made of sheet material such as glass, acrylic or wood and is preferably surrounded by a peripheral frame 94. Frame 94, for example, can be an aluminum frame. Preferably, panel 92 defines a panel opening 96 in substantially a size and shape, for example a square or rectangle, to allow passage of a connection from rim bracket 104 to forward bracket 86. An optional spacer pad 110 may be used between rim bracket 104 and forward bracket 86. Forward bracket 86 may also be secured, for example at its lower edge to the backboard assembly frame 94 to assist in maintaining the backboard assembly stable and in a desired vertical axis B-B.

Rim assembly 100 is not connected to backboard panel 92. In certain embodiments, rim bracket 104 is directly and securely connected to forward bracket 86 through opening 96, for example with four bolts. As such, force transmitted to the rim assembly 100 is directly transmitted to bracket 86 and brace 80 without applying stress or force to the backboard panel.

In certain preferred embodiments, axes of forward arms 70, brace 80 and backboard assembly 90 form a fixed triangle as seen in FIG. 6. Specifically, axes $A_2$-$A_2$, B-B and F-F are connected at fixed angles $\theta$, $\alpha$ and $\beta$ which do not pivot or change as the height of backboard assembly 90 is raised and lowered. Further, by maintaining non-vertical axis $A_2$-$A_2$ parallel to non-vertical fixed axis $A_1$-$A_1$ associated with vertical support 20, the linkage maintains backboard axis B-B is a substantially vertical orientation perpendicular to the support surface regardless of height.

Figure 7:
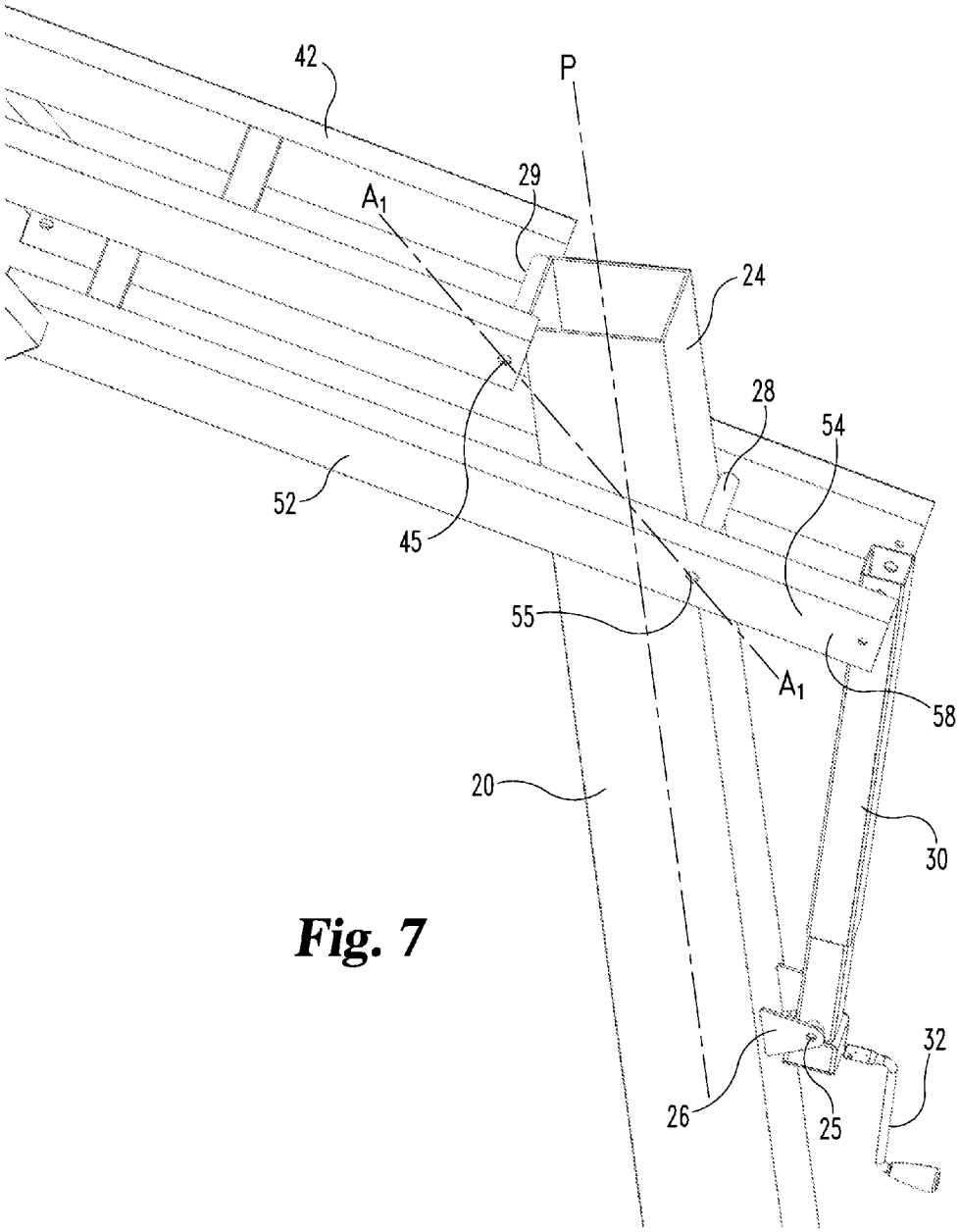
FIG. 7 is a perspective view of the upper end of the support assembly of FIG. 1.

Illustrated in detail in FIG. 7, lower rear pivot point 55 is preferably mounted to upright 20 at a distance offset rearward from pole axis P-P of support 20, for example with a bolt or axle through a rear pivot channel 28. Preferably upper rear pivot point 45 is mounted to upright 20 at a distance offset forward of pole axis P-P, for example using a bolt or axle extending through a forward pivot channel 29. As example, pivot channels 28 and 29 may be formed by drilled holes in support 20 or by pivot tubes welded to support 20. Preferably the respective offset distances of lower rear pivot point 55 and upper rear pivot point 45 define a non-vertical angled axis $A_1$-$A_1$ at a fixed angle relative to pole axis P-P and forming one side of the parallelogram arrangement. The longitudinal axis of $A_2$-$A_2$ of forward arms 70 is parallel to axis $A_1$-$A_1$. In alternate embodiments, the upper rear pivot point can be mounted rearward of axis P-P and the lower pivot point is mounted forward, with a corresponding angular change in the forward arms, brace and fixed triangle mounting of backboard assembly 90.

In operation, crank 32 may be turned by a user to extend or retract cylinder 30 and to correspondingly raise or lower extension end 58 of the parallelogram relative to pivot point 25. Pivotal movement of the rearward extension end 58 around lower rear pivot point 55 correspondingly lowers or raises the forward end 56 of lower arms 52 and through the linkage arrangement correspondingly raises and lowers upper arms 42 and forward arms 70. Raising and lowering of forward arms 70 controls the raising and lowering of backboard assembly 90 and correspondingly rim assembly 100 to a desired height.

The goal assembly may be made from standard materials such as steel or stainless steel. The pole, support arms and rim assembly may be painted for distinctiveness or decoration and to protect the metal of the goal assembly.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A basketball goal system, comprising:

a) a support;

b) a backboard assembly including a backboard panel and a basketball rim assembly mounted approximate the center width of said backboard panel;

c) a parallelogram structure having a pair of upper arms each with a first end and a second end with said first ends pivotally connected to said support and a pair of lower arms each with a first end and a second end with said first ends pivotally connected to said support;

d) wherein said parallelogram structure includes a pair of arm portions pivotally connected between said second ends of said upper arms and said second ends of said lower arms;

e) a brace assembly extending forward of said arm portions along a non-vertical axis to support said backboard assembly;

f) said brace assembly defining a central brace portion connected between said arm portions and said backboard assembly adjacent the rear of said basketball rim assembly; and, g) said brace assembly defining horizontally extending brace portions connected to opposing portions of said backboard assembly laterally offset from said basketball rim assembly.

2. The basketball goal system of claim 1, wherein said horizontally extending brace portions and said central brace arm are each connected to said backboard assembly in fixed, non-pivoting angular relationships.

3. The basketball goal assembly of claim 2, wherein said horizontally extending brace portions, said backboard assembly and said central brace portion define a vertical triangular with an open center.

4. The basketball goal system of claim 1, wherein said horizontally extending brace portions are connected to said backboard assembly at a height above said basketball rim assembly.

5. The basketball goal assembly of claim 1, wherein axes of said horizontally extending brace portions, said backboard assembly and said central brace portion define a vertical triangle with fixed angles.

6. The basketball goal system of claim 1, wherein lateral brace arms each have a longitudinal length with an upper end portion connected to said backboard assembly and a lower end portion connected to said central brace arm.

7. A basketball goal system, comprising:

a) a vertical support;

b) a backboard assembly including a backboard panel and a basketball rim assembly mounted to said backboard panel;

c) a parallelogram structure having a pair of upper arms each with a first end and a second end, with said first ends pivotally connected to said support and a pair of lower arms each with a first end and a second end, with said first ends pivotally connected to said support;

d) wherein said parallelogram structure includes a pair of arm portions connected to said second ends of said upper arms and said second ends of said lower arms;

e) a brace assembly extending forward of said arm portions along a non-vertical axis to support said backboard assembly;

f) said brace assembly including a central brace portion connected to said backboard assembly at a central point and two offset brace portions connected to said backboard assembly at points laterally offset on opposing sides of said central brace portion.

8. The basketball goal system of claim 7, wherein said offset brace portions each have a longitudinal length with an upper end portion connected to said backboard assembly and a lower end portion connected to said central brace portion.

9. The basketball goal system of claim 7, wherein said offset brace portions are connected to said backboard assembly at a height above said basketball rim assembly.

10. The basketball goal system of claim 7, wherein offset brace portions and said central brace portion are each connected to said backboard assembly in fixed, non-pivoting angular relationships.

11. The basketball goal system of claim 7, wherein said offset brace portions diverge from said central brace portion at a connection point spaced rearward of said backboard assembly.

12. A basketball goal system, comprising:

a) a vertical support;

b) a backboard assembly including a backboard panel and a basketball rim assembly mounted to said backboard panel;

c) a pair of upper arms each with a first end and a second end, with said first ends pivotally connected to said support and a pair of lower arms each with a first end and a second end, with said first ends pivotally connected to said support;

d) a brace assembly including a pair of arm portions pivotally connected to said second ends of said upper arms and said second ends of said lower arms, e) a brace assembly extending forward of said arm portions along a non-vertical axis to support said backboard assembly;

f) wherein said upper arms and said lower arms form parallel upper and lower portions of a parallelogram structure, and wherein said support and said arm portions form parallel forward and rearward portions of said parallelogram structure;

g) said brace assembly including a central brace arm connected to a central portion of said backboard assembly and two lateral brace arms connected to said backboard assembly at points laterally offset on opposing sides of said central brace arm.

13. The basketball goal system of claim 12, wherein said lateral brace arms each have a longitudinal length with an upper end portion connected to said backboard assembly and a lower end portion connected to said central brace arm.

14. The basketball goal system of claim 12, wherein the upper ends of said lateral brace arms are connected to said backboard assembly at a height above said basketball rim assembly.

15. The basketball goal system of claim 12, wherein said lateral brace arms diverge from said central brace arm at a connection point spaced rearward of said backboard assembly.

16. The basketball goal assembly of claim 12, wherein said lateral brace arms and said backboard assembly define an open triangular area in a horizontal plane.

17. The basketball goal system of claim 12, wherein lateral brace arms and said central brace arm are each connected to said backboard assembly in fixed, non-pivoting angular relationships.

18. The basketball goal assembly of claim 12, wherein axes of said lateral brace arms, said backboard assembly and said central brace arm define an open triangular area in a vertical plane.

19. The basketball goal system of claim 12, wherein axes of said lateral brace arms, said central brace arm and said backboard assembly form a fixed triangle in a vertical plane with angles which do not change as the height of said backboard assembly is adjusted.

* * * * *